US005972060A

United States Patent [19]

O'Halloran et al.

[11] Patent Number: 5,972,060

[45] Date of Patent: *Oct. 26, 1999

[54] APPARATUS FOR PROVIDING A PURIFIED RESOURCE IN A MANUFACTURING FACILITY

[75] Inventors: Michael D O'Halloran, Portland; Wilmar A Kohne, Salem; Stephen W Nelson, West Linn, all of Oreg.

[73] Assignee: CH2MHill Industrial Design Corporation, Portland, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,997

[22] Filed: Oct. 9, 1996

[51] Int. Cl.[6] ..... B01L 1/04; F24F 7/06

[52] U.S. Cl. ..... 55/385.2; 55/420; 55/424; 55/467; 96/400; 454/187

[58] Field of Search ..... 55/385, 2, 420, 55/424, 467, 417; 454/187; 96/400, 402

[56] References Cited

U.S. PATENT DOCUMENTS

| | | | |
|---|---|---|---|
| 4,175,934 | 11/1979 | Lang et al. | 55/417 |
| 4,549,472 | 10/1985 | Endo et al. | 55/385.2 |
| 4,699,640 | 10/1987 | Suzuki et al. | 55/385 |
| 4,705,066 | 11/1987 | Gut et al. | 55/417 |
| 4,838,150 | 6/1989 | Suzuki et al. | 98/31.5 |
| 5,058,491 | 10/1991 | Wiemer et al. | 98/115.3 |
| 5,096,477 | 3/1992 | Shinoda et al. | 55/385.2 |
| 5,181,819 | 1/1993 | Sakata et al. | 414/217 |
| 5,195,922 | 3/1993 | Genco | 454/57 |
| 5,259,812 | 11/1993 | Kleinsek . | |
| 5,316,518 | 5/1994 | Challenger | 55/385.2 |
| 5,401,212 | 3/1995 | Marvell et al. | 454/187 |
| 5,431,599 | 7/1995 | Genco | 454/187 |
| 5,447,002 | 9/1995 | Wehrmann | 52/239 |
| 5,626,820 | 5/1997 | Kinkead et al. | 55/385.2 |

FOREIGN PATENT DOCUMENTS

| | | | |
|---|---|---|---|
| 0787950A1 | 8/1997 | European Pat. Off. . | |
| 62-22938 | 1/1987 | Japan | 55/385.2 |
| 64-46528 | 2/1989 | Japan | 55/385.2 |
| 2147409 | 5/1985 | United Kingdom . | |

OTHER PUBLICATIONS

United States Patent and Trademark Office, PCT Preliminary Examination Report Nov. 3, 1998.

United States Patent and Trademark Office, PCT Written Opinion, Jul. 1, 1998.

*Primary Examiner*—C. Scott Bushey
*Attorney, Agent, or Firm*—Charles E. Gotleib

[57] ABSTRACT

A method and apparatus provides a resource capable of affecting the manufacture of a product to a bay and a chase. Clean resource is supplied to the bay where it is used to affect the manufacture of a product in one or more steps highly sensitive to contaminants in the resource. The resource contaminated by the manufacture of the product is then sent to a chase where it is further used to affect the manufacture of the same or a different product in steps that are less sensitive to the contamination of the resource. Because the bay is most sensitive to contaminants in the resource, the impurified resource received at the chase may not adversely affect the manufacture of products in the chase and thus, supplying a clean resource to the chase is unnecessary.

20 Claims, 8 Drawing Sheets

APPARATUS FOR PROVIDING A PURIFIED RESOURCE IN A MANUFACTURING FACILITY

FIELD OF INVENTION

The present invention relates to manufacturing facilities and more specifically to the control of the purity of resources in manufacturing facilities.

BACKGROUND OF THE INVENTION

Many manufacturing facilities which use multistep processing of materials to produce products have a similar resource at two or more steps. Some resources are used as a part of the manufacturing process, while other resources, such as air, may be present and can affect the process, but are not intended to be used by the process. In the case of air, it may be used by one process step, but merely present at another. Whether the resource is used or not, it is often desirable to control impurities which can otherwise contaminate the results of the manufacturing process.

For example, the manufacture of semiconductors from silicon wafers is a multistep process that is sensitive to impurities in the ambient air. At some steps in the process, the ambient air is relied upon to oxidize the silicon. At other steps in the process, ambient air is not used. At still other steps in the process, the existence of any ambient air actually disrupts the process step. In these latter types of steps, the process is performed in a vacuum, the achievement of which is an expensive, time consuming step as wafers are loaded by an operator who cannot work in a vacuum into equipment which must create a vacuum to operate.

In semiconductor fabricating facilities, or "fabs," particulate matter is a concern, because it interferes with the photolithographic, implant, etch or other processes that are used to form extremely tiny patterns on the wafers which are used to create the circuitry on the semiconductor. Because the patterns formed onto the silicon are so tiny, such processes requires extreme precision, and dust or pollen could dramatically alter the patterns created, causing the failure of the resulting semiconductor product. As operators of the equipment enter the fab, they carry this particulate matter with them which they stir up in the air as they move about the fab.

To combat the particulate problems, the air in prior art fabs was controlled to eliminate particulate matter, a process for which fabs are often referred to as "cleanrooms." Referring now to FIG. 1, a conventional fab is shown. The work area of the fab 100 has processing machines 120B, 120C, 122B, 122C, 124B, 124C, 126B, 126C on which or in which semiconductors are manufactured. Outside air 108 is cleaned of most particulate matter and pumped into the fab 100 by make up air handler unit 104 via inlet 132. One purpose a make up air handler unit 104 serves is to replace air that is lost accidentally through leakage in the walls, floor and ceiling of the work area of the fab 100. Make up air handler unit also resupplies oxygen lost by the breathing of the operators in the work area of the fab 100 and by the operation of some of the processing equipment 120B, 120C, 122B, 122C, 124B, 124C, 126B, 126C in the work area of the fab 100. Make up air handler unit 104 also resupplies air lost purposely through outlet 136 to outside air 109. Air contaminated with particulate matter is allowed to escape to outside air 109 in order to replace it with cleaner air from make up air handler unit 104, a process which serves to clean the air in the work area of the fab 100. Additionally, make up air handler unit 104 serves to pressurize the work area of the fab 100 in order to keep dust from entering the fab 100 from holes and cracks in the walls, flow and ceiling. Outlet 136 may contain a pressure controlled valve or fan to help ensure this pressurizing process is controlled.

To further clean the air in the work area of the fab 100, recirculation air handling unit 102 recirculates and filters particles in the air in the work area of the fab 100 via inlet 130, outlet 134 and conduit or duct 110.

The purity of the air is a function of the volume of air in the fab 100, the purity of and volume of the air from make up air handler unit 104, the effectiveness of, purification ability of, and volume of the air through, the recirculation air handling unit 102 and the generation of contamination from processing equipment 120B, 120C, 122B, 122C, 124B, 124C, 126B, 126C and other contamination, such as that brought in by the operators. If all of these factors are held to a constant rate, the level of contaminants in the air resource will reach an equilibrium level. Reduction of contamination may be made by varying any of the factors.

Another form of impurity can affect the operation of the circuitry in a semiconductor. Molecular impurities, particularly some organic molecules, metal ions, salts and heavy metals can affect the circuitry by interfering with the behavior of the various layers of the semiconductor device, which affect the characteristics of the semiconductor device. As device sizes in a semiconductors are reduced, the disruption of the semiconductor by a stray molecule plays an increasing role in the failure rate of the semiconductors produced in the fab 100.

For example, processing equipment 120B, 122B, 124B, 126B may include equipment used to increase the oxidation layer of the silicon used to manufacture semiconductors. Silicon exposed to air forms a layer of oxidation on its outer surface which can protect the silicon against molecular impurities. Naturally, this layer does not have adequate thickness to protect the silicon against the environmentally available molecular impurities to which the semiconductor may be exposed. However, the oxidized silicon may be driven deeper into the silicon by heating it. When the new layer of oxidation forms on the outer surface, the result is a thickened layer of oxidation that is adequate to protect the semiconductor against molecular impurities. Unfortunately, any molecular contamination on the surface of the silicon will also be driven into the silicon during this heating process.

Thus, the steps performed by processing equipment 120B, 122B, 124B, 126B are among the most sensitive to chemical impurities, yet produce very low levels of molecular contamination, mostly from contaminants introduced by other processing steps or other sources.

The molecular impurities may be introduced in the fab from the operators entering the fab and from the outside air introduced into the fab. In addition, the gases and chemicals used within some of the processing equipment 120C, 122C, 124C, 126C used in the fab itself to process the semiconductors, piping systems used to deliver these gases and chemicals, maintenance activities or accidents can also introduce a source of impurities in the ambient air in the fab. This equipment 120C, 122C, 124C, 126C may include vapor deposition equipment, ion implantation equipment, etch and other equipment which are used to deposit materials ON, dope, clean or etch, the semiconductor wafer. Because these types of equipment 120C, 122C, 124C, 126C serve as a source of stray molecules to which other processing equipment 120B, 122B, 124B, 126B is most sensitive, the two types of processing equipment 120B, 122B, 124B, 126B, and 120C, 122C, 124C, 126C are incompatible.

While the recirculation air handling unit 102 and make up air handler unit 104 equipment were improved to help remove molecular impurities from the outside air 108 and from recirculated air from the work area of the fab 100, the processing equipment 120C, 122C, 124C, 126C which served as an internal source of impurities remained a significant source.

The impact of this problem has been reduced in conventional chip fabricating facilities by separating the incompatible equipment in a "bay" and a "chase". The bay is a separate area of the fab that is used for processing steps that are most sensitive to impurities in a resources, while the chase is used for processing steps that are least sensitive to impurities in the resource. Referring now to FIGS. 1 and 2, the bay 100B contains processing equipment 120B, 122B, 124B, 126B and the chase 100C contains processing equipment 120C, 122C, 124C, 126C.

To maintain the purity of the air in each area 100B, 100C, each has its own make up air handler unit 104B, 104C supplying outside air 108. The particulate and molecular contamination in the outside air is filtered by make up air handler units 104B, 104C before pumping into bay 100B via inlet 132B and into chase 100C via inlet 132C. Recirculation air handling unit 102B, 102C recirculates and may filter particulate contamination only or particulate and molecular contamination via inlets 130B, 130C, outlets 134B, 134C and conduits 110B, 110C, which operate as inlet 130, outlet 134 and conduit 110 described above with reference to FIG. 1. Because the air supply and recirculation air handling unit system in the bay 100B and chase 100C operate independently, the significant source of molecular impurities from processing equipment 120C, 122C, 124C, 126C in the chase 100C does not contaminate the air resource supplied to processing steps performed in the bay 100B.

Outlets 136B, 136C to outside air 109 may contain valves or fans as described above with reference to FIG. 1, and may contain additional filtration equipment to lower the contamination of the outside air 109. Although the outlets 136, 136B, 136C to outside air 109 may be located at an area distant from inlets 132, 132B, 132C to outside air 108, cross contamination may occur making such additional filtration desirable.

The two systems, one for the bay 100B and one for the chase 100C allow the bay 100B and the chase 100C to each attain an equilibrium level of particulate and molecular contaminants, similar to that described above with reference to FIG. 1 for particulate contaminants. Because the bay 100B and the chase 100C operate as independent systems, the equilibrium levels are independent of each other, except for cross contamination of outside air.

In some types of semiconductor processing equipment 120B, 120C both are part of the same machine, and processing equipment 120B is incompatible with processing equipment 120C as described above. In such case, the bay 100B and the chase 100C may be adjacent to one another, the machine 120B and 120C is mounted into the wall separating the bay 100 and the chase 100C with the portion 120B of the machine most sensitive to contamination, such as a load port, located in, or having an door opening to, the bay 100B and the less sensitive portion 120C of the machine is located in the chase 100C.

Reducing molecular and particulate contamination is an expensive process. Nevertheless, as device sizes in semiconductors are reduced, impurities in the air in the bay 100B must be further reduced to maintain the yields of chips undamaged by contamination. It is desirable to minimize the contamination of the air in the bay for a given cost of purification of the air resource.

SUMMARY OF THE INVENTION

Purified air is fed into the bay, and at least a portion of the exhaust from the bay is fed into the chase. This allows the expense of the purification equipment to be focused on the bay, where the sensitivity to impurities is greatest. For example, the make up air handler unit air unit that would otherwise be used to purify and feed air into the chase may instead be totally used to feed air into the bay, dramatically reducing the equilibrium level of contamination in the bay without the use of additional equipment. Although the chase receives air that is more contaminated than prior art methods, the relatively clean exhaust of the bay only marginally raises the level of contamination from that produced by the manufacturing processes in the chase. Additionally, because of the reduced susceptibility to contamination of the processes in the chase, the benefits of cleaner air in the bay outweigh the detriment of dirtier air in the chase.

BRIEF DESCRIPTION OF THE INVENTION

DETAILED DESCRIPTION OF A PREFERRED EMBODIMENT

Manufacturing facilities use or have "resources" which are any material in solid, liquid or gas forms which are used in, or are incidental to, manufacturing of any material, and in which it is desirable to reduce contaminants to at least a threshold level. Resources which are incidental to a manufacturing facility may include resources which are ambient to the manufacturing process without being consumed by the manufacturing process, such as air in many manufacturing facilities, or water for cleansing a finished product. Whether the resource is used in the manufacturing process or is ambient to the process, as used herein a resource has the ability to affect a product manufactured by the process.

A resource may be a gas, liquid or solid form of any pure element in the periodic table of elements, a compound formed from such elements, or a mixture of one or more pure elements or compounds. Water is an example of a compound of hydrogen and oxygen in liquid form, while air is an example of a mixture of compounds such as water and carbon dioxide as well as pure elements such as oxygen, hydrogen and nitrogen.

One type of resource used in and ambient to a semiconductor fab is air. In a semiconductor manufacturing facility, air is a resource that is required by two areas of the fab, a bay and a chase. A "bay" is an area of a manufacturing facility in which processing occurs of materials or in steps having a greater susceptibility to contaminants in a resource than that of a different area of a manufacturing facility called a "chase" which is primarily closed off from the bay. For example, in a semiconductor fab, the bay 100B and chase 100C are separate rooms walled off from one another, with a doorway in between them. There may be equipment to prevent the air in the chase 100C from entering the bay 100B, such as pressurizing equipment in the bay 100B that maintains a higher pressure than that of the chase 100C. The bay 100B and the chase 100C need not be separate rooms, as they may also be different areas of a piece of processing equipment that have the differing requirements of purity.

Figure 2:
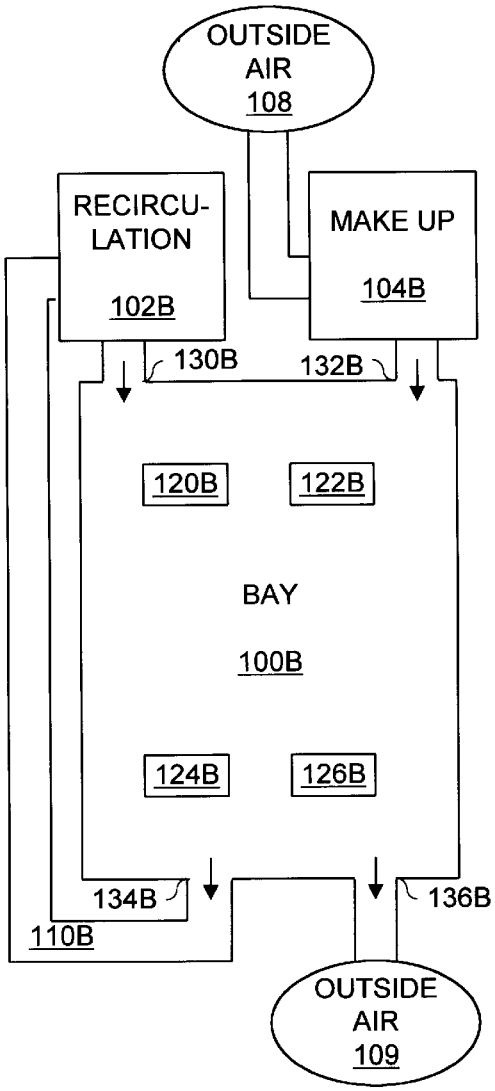
FIG. 2 (PRIOR ART)
FIG. 2 is a a block diagram of conventional air processing equipment in a fab employing a bay and a chase with a separated air flow for contamination control.
Figure 2:
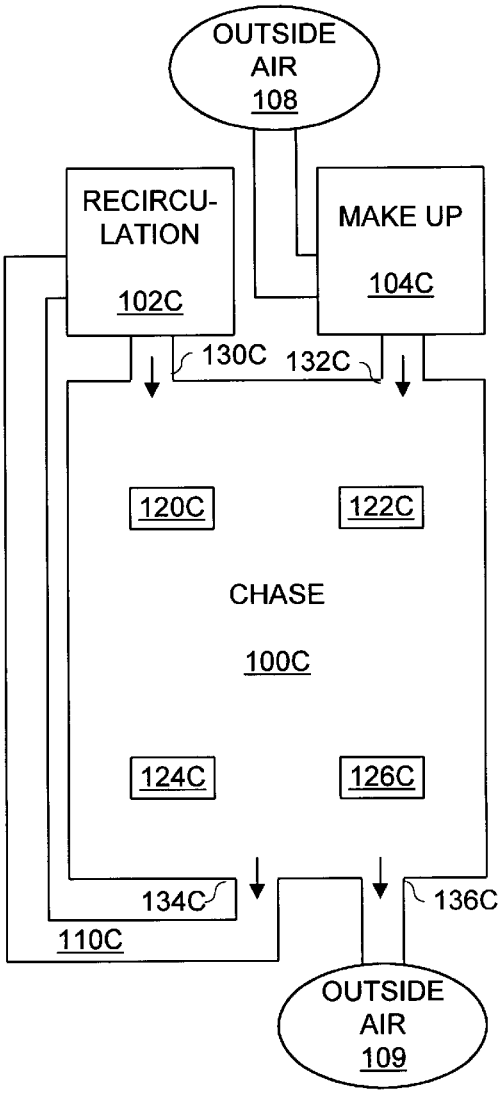
FIG. 2 (PRIOR ART)
Figure 3:
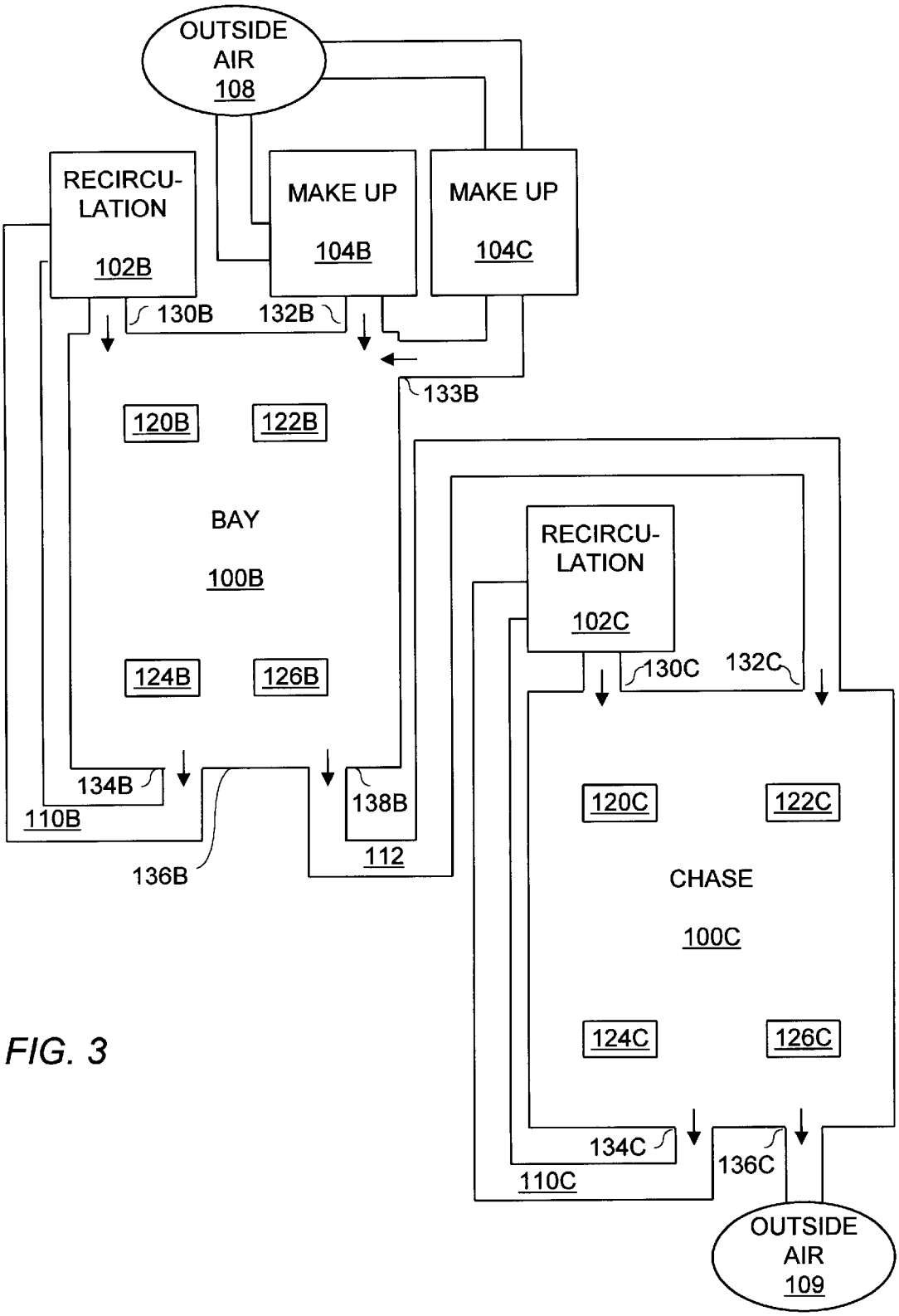
FIG. 3 is a block diagram of air processing equipment in a fab employing a bay and a chase according to one embodiment of the present invention.

Referring now to FIG. 3, an apparatus which provides air to a bay 100B and a chase 100C according to one embodiment of the present invention is shown. A bay 100B and a chase 100C are provided with semiconductor processing equipment 120B, 122B, 124B, 126B in the bay 100B and semiconductor processing equipment 120C, 122C, 124C, 126C in the chase 100C. Recirculation air handling unit 102B performs the recirculation function in the bay 100B, and recirculation air handling unit 102C performs the recirculation function in the chase 100C described above with reference to FIG. 2. In one embodiment, recirculation air handling units 102B and 102C are conventional cleanroom recirculation air handling units commercially available from Pace Company of Portland Oreg., or Accoustiflo, LLC of Boulder, Colo. and having the specifications set forth in Exhibit A, although the present invention can operate with any recirculation air handling unit or with no recirculation air handling unit. The recirculation air handling unit may include particle filtration, chemical filtration or no filtration.

Figure 1:
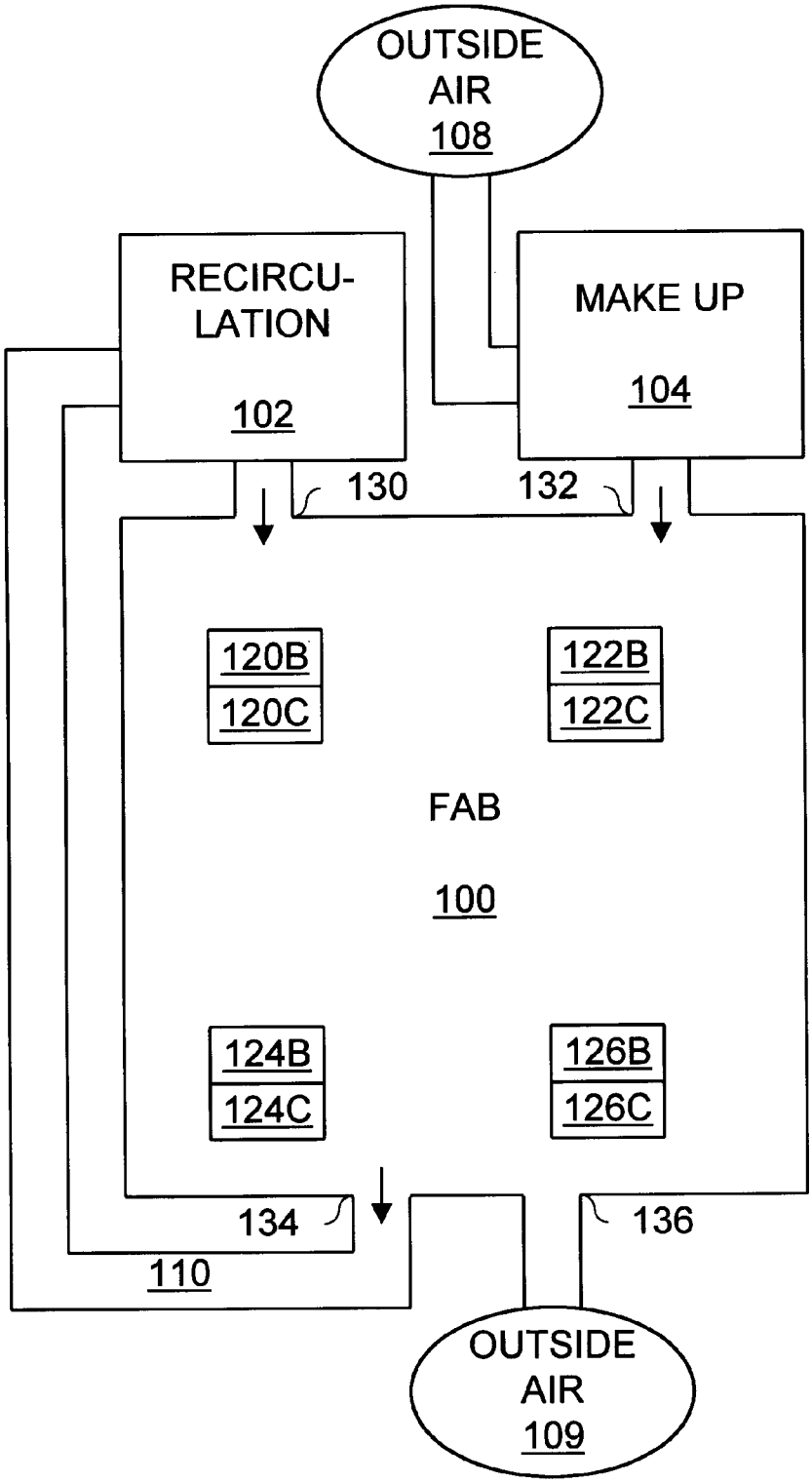
FIG. 1 (PRIOR ART)
FIG. 1 is a block diagram of conventional air processing equipment in a conventional fab.

In one embodiment, make up air handling unit 104B serves to provide purified make up air from outside air 108 as described above with reference to make up air handling unit 104 of FIG. 1. In one embodiment, make up air handling units 104B and 104C described below are conventional make up air handling units commercially available from Pace Company of Portland Oreg. or York International Corporation of York, Pa. and having the specifications set forth in Exhibit B, although the present invention can operate with any source which supplies a relatively contaminant free resource. In one embodiment, the make up air handling unit purifies the resource of most contaminants where the resource is not supplied pure or nearly pure. In one embodiment, the purification of the air resource is provided by conventional HEPA air filter equipment 99.9995 percent efficient at 0.12 micron to 0.2 micron size contaminants. In other embodiments, filtration is provided by conventional water wash equipment, conventional chemical filtration equipment such as carbon filtration equipment, conventional moisture condensation filter equipment. Such filtration equipment may be considered herein as part of the make up air handling units 104B, 104C and is commercially available from the air handling unit 104B, 104C suppliers described above.

Passage 112, which may be a duct, an opening, a damper, a fan or other similar device, connects the bay 100B and the chase 100C to provide the impure air from the bay 100B to the chase 100C. In one embodiment, make up air handling unit 104C is not in its position shown in FIG. 2 feeding purified air into the chase 100C, but instead positioned to provide increased flow of purified air into the bay 100B. Although the make up air handling unit 104C is shown in FIG. 3, the present invention would operate with only a single make up air handling unit 104B. The Figure uses make up air handling unit 104C, which supplied purified outside air to the chase 100C in FIG. 2 to illustrate that greater air handling capacity may be focused on the bay 100B without the need for more air handling equipment than is used in both the bay 100B and chase 100C of prior art systems. In one embodiment, outlet 136B is not used to allow air to escape to the outside as described above with reference to FIG. 2, so that the exhaust from the bay 100B may instead fully flow into the chase 100C.

Figure 4:
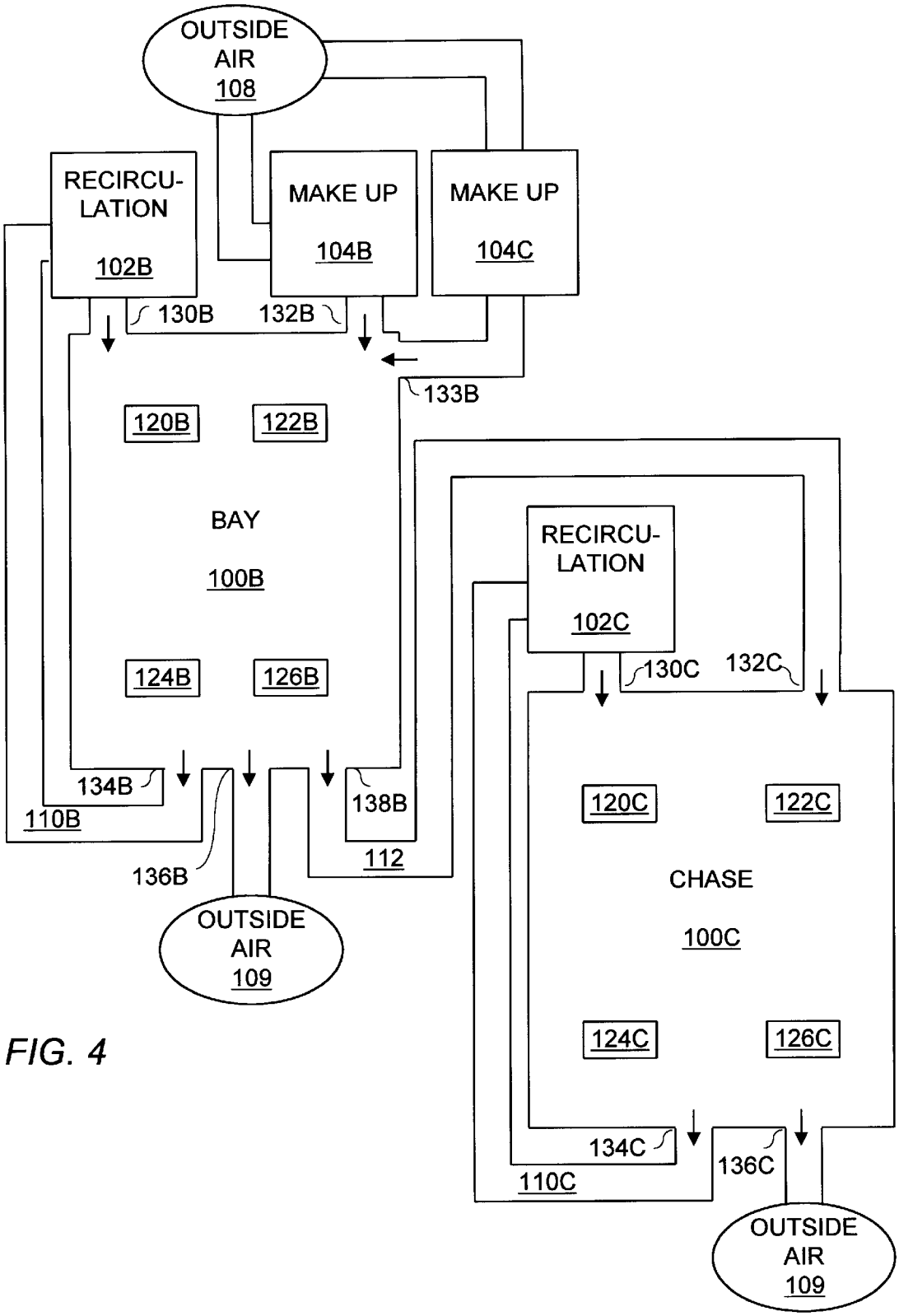
FIG. 4 is a block diagram of air processing equipment in a fab employing a bay and a chase according to an alternate embodiment of the present invention.

Referring now to FIG. 4, an apparatus which provides clean air to a bay and a chase according to one embodiment of the present invention is shown. The outlet 136B of FIG. 2 which allows some of the air in the bay 100B to be exhausted to the outside is used in addition to the outlet 138B to the inlet 132C of the chase 100C so that some of the air in the bay 100B is passed to the air outside 109 and the remainder is passed to the chase 100C via conduit 112. In one embodiment, outlet 136B is located in the portion of the bay 100B with the highest detected level of contaminants as measured by a conventional ion chromatography or inductively coupled plazma—mass spectrometry techniques or other similar techniques, and outlets 134B, 138B are located in areas with lower measured contamination as measured by the same techniques. The level of contamination of the air flowing to the chase 100C via duct 112 may be thus further reduced by the location of the outlet 138B.

Figure 5:
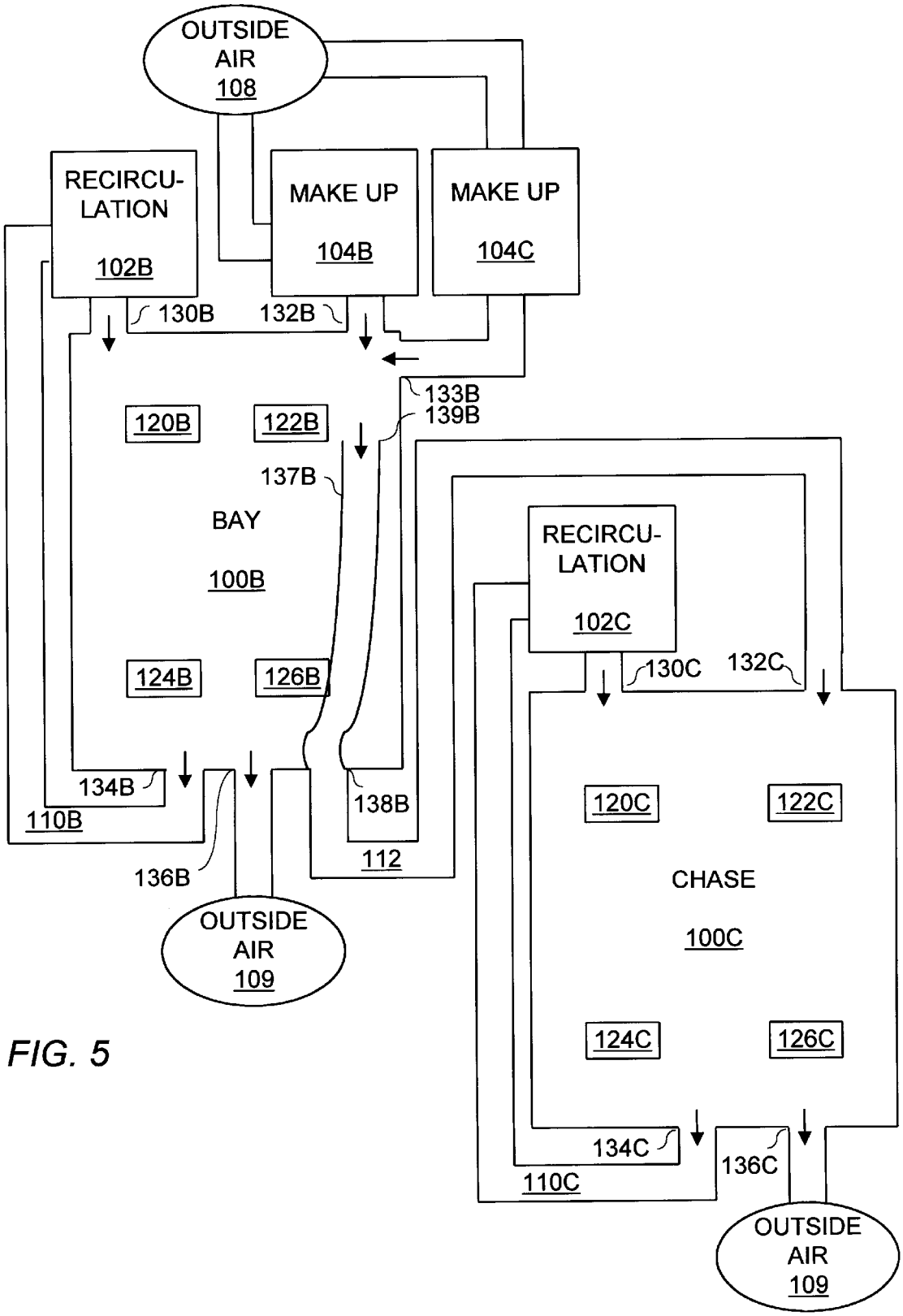
FIG. 5 is a block diagram of air processing equipment in a fab employing a bay and a chase according to an alternate embodiment of the present invention.

Referring now to FIG. 5, an apparatus which provides clean air to a bay and a chase according to one embodiment of the present invention is shown. The apparatus shown in FIG. 5 operates similarly to that of FIG. 4, with the addition of a moveable tube 137B having inlet 139B to allow the source of air to conduit 112 to be repositioned more easily as contaminant levels change, for example through the replacement or shut down of equipment 120B, 122B, 124B, 126B.

Figure 6:
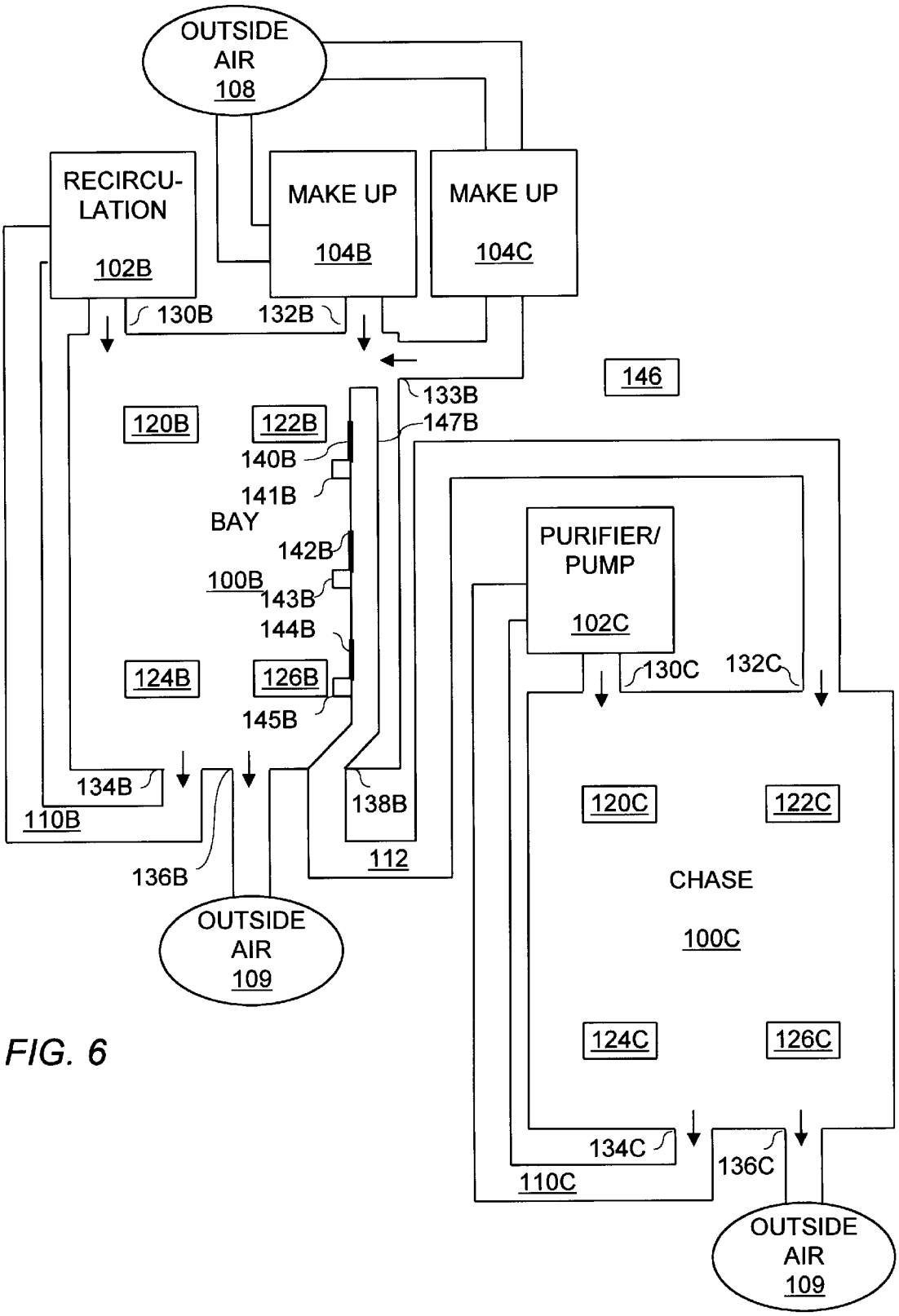
FIG. 6 is a block diagram of air processing equipment in a fab employing a bay and a chase according to an alternate embodiment of the present invention.

Referring now to FIG. 6, an apparatus which provides clean air to a bay and a chase according to one embodiment of the present invention is shown. The apparatus of FIG. 6 operates similarly to that of FIG. 4, with the addition of conventional IBM-compatible 586 personal computer 146 coupled to contamination sensors 141B, 143B, 145B and conventional motorized air duct shutoff valves 140B, 142B, 144B mounted on duct or conduit 147B (connections to the computer 146 are not shown to avoid cluttering the Figure). In one embodiment, conventional contamination sensors 141B, 143B, 145B commercially available as model CM4 Continuous Gas Monitor from Zellweger Analytics of Linconshire, Ill. detect the presence of hydrochloric acid contaminants and are used along with conventional motorized air duct valves, commercially available from Pace Company of Portland Oreg., or York International Corporation of York, Pa. Software in computer 146 monitors the signals sensors 141B, 143B, 145B which indicate the level of contaminants detected by sensors 141B, 143B, 145B and sends a signal to open motorized air duct valve or valves 140B, 142B, 144B corresponding to the one or more sensors 141B, 143B, 145B that are detecting the lowest levels of contaminants in the air in the bay 100B to feed duct 112 with air from the bay, with the other valves 140B, 142B, 144B being closed, or receiving signals from computer to close.

Figure 7:
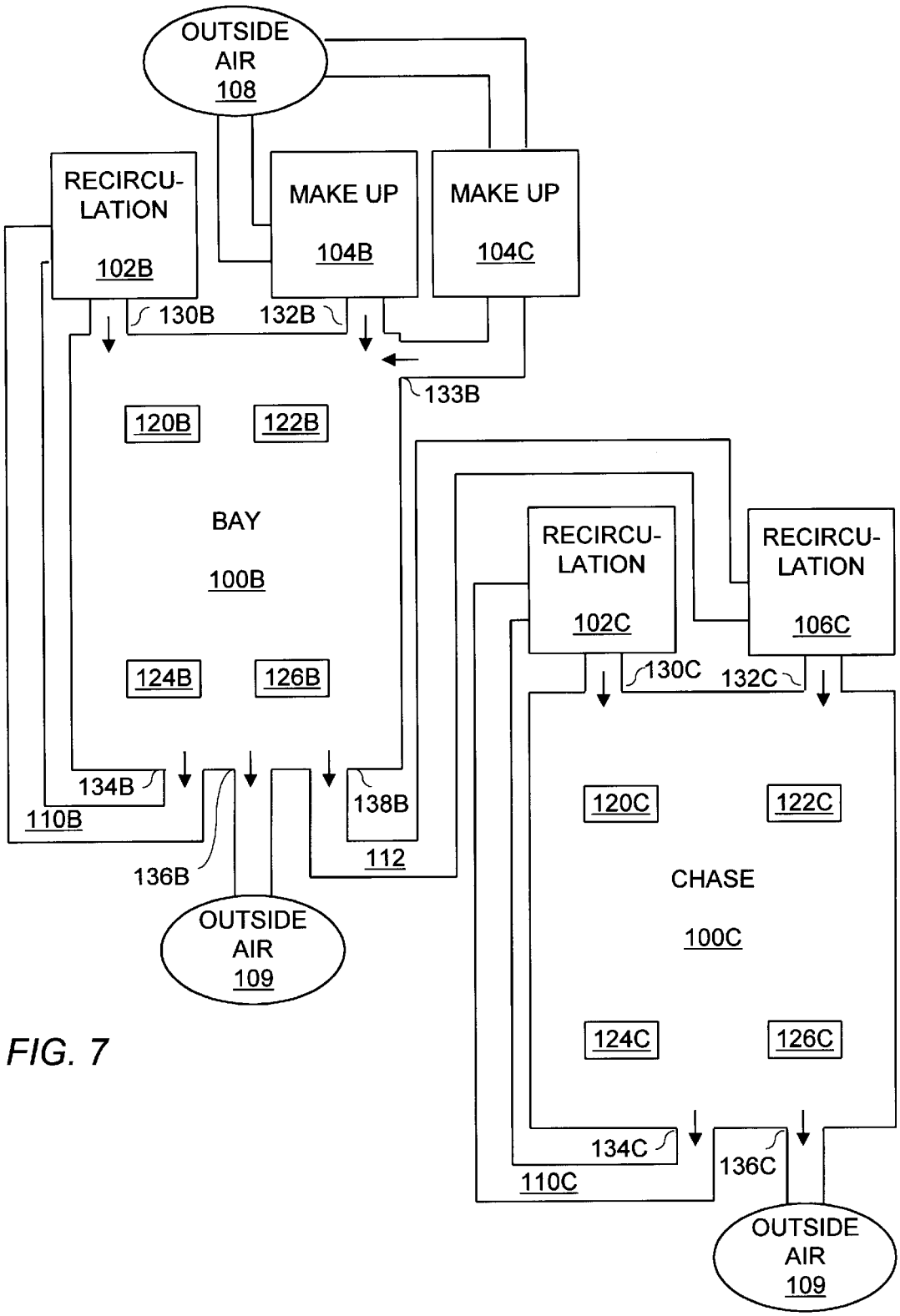
FIG. 7 is a block diagram of air processing equipment in a fab employing a bay and a chase according to an alternate embodiment of the present invention.

In the event that the air supplied via duct 112 cannot supply an adequately pure resource, it may be further filtered. Referring now to FIG. 7, one embodiment of an apparatus which supplies clean air to a bay and a chase is shown. The apparatus is the same as that of FIG. 4, with the addition of recirculation air handler unit 106C, similar to recirculation air handler unit 102C, coupled between duct 112 and inlet 132C to further remove contaminants from the air supplied via duct 112. Such an embodiment may be useful to slightly reduce contaminants where the amount supplied via duct 112 are unacceptably high. Also, where the air supplied from duct 112 is free of some types of contaminant but not others, recirculation air handler unit 106C can provide further filtration of only the contaminants at an unacceptably high level, without having to filter the remainder of the contaminants that are already filtered by make up air handler units 104B and 104C as well as recirculation air handler unit 102B.

Figure 8:
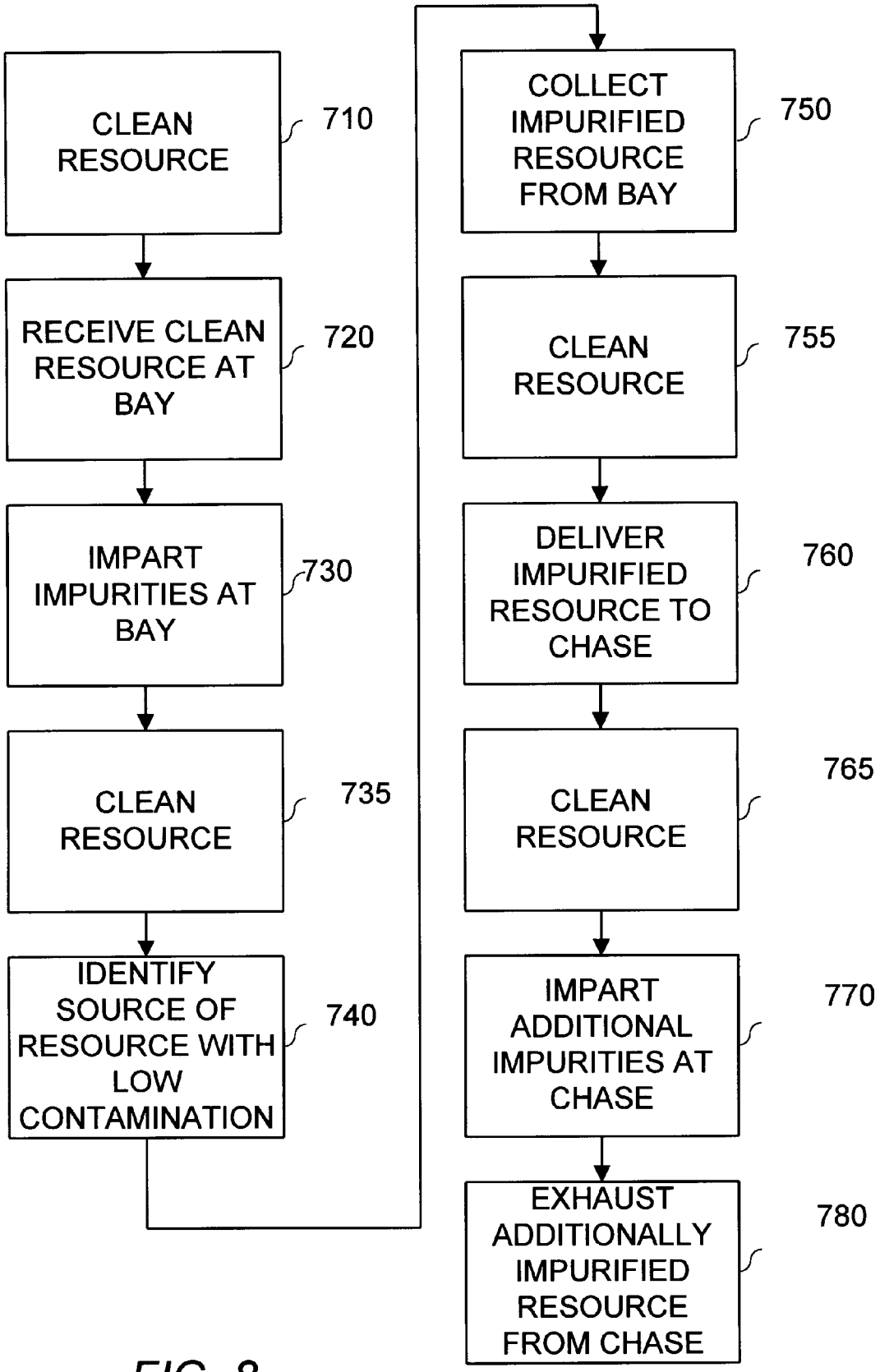
FIG. 8 is a flowchart illustrating a method of providing an air resource to a bay and a chase according to one embodiment of the present invention.

Referring now to FIG. 8, one embodiment of a method of providing substantially pure air to a bay and a chase is shown. The resource may be optionally purified of substantially all of its contaminants 710 in the event that it is not supplied clean using conventional water wash, chemical filtration such as using a carbon filter, moisture condensation or HEPA air filtration techniques 99.9995 percent efficient at 0.12 micron to 0.2 micron size contaminants. Purification or cleansing of substantially all of the contaminants means cleansing to an acceptably low level of contaminants. What is an acceptably low level of contaminants will vary depending on the manufacturing process used, but should provide a failure rate not higher than the one desired. In the fabrication of semiconductors, a supply of air having particulate matter of no more than 3.5 particles per cubic meter greater than 0.1 micron and chemical composition of no more than 1 microgram of ionic contaminants per cubic meter, 0.1 microgram of sodium contaminants per cubic meter, 10 parts per billion of hydrocarbon content and 100 micrograms of volatile organic compounds per cubic meter is presently considered having an acceptably low level of contamination. A resource with such acceptably low level of contamination is considered "clean." The resource such as air is received at the bay 720 and impurities are imparted or allowed to be imparted to the resource in the bay 730. Optionally, a source resource with low contamination is identified in the bay 740. A source of resource with low contamination is an area of the bay in which the contaminant levels measured using the contaminant measurement techniques described above result in a measurement of one or more contaminants that are lower than the average level in the bay. The impurified resource is collected 750 either from the source identified in step 740 or elsewhere in the bay, and delivered to a chase 760. Additional impurities are imparted at the chase 770, and at least a portion of the additionally impurified resource may be exhausted from the chase. Optionally, the resource may be cleaned by the removal of some or all contaminants at some or all of steps 735, 755, or 765 using conventional water wash, chemical filtration such as using a carbon filter, moisture condensation or HEPA air filtration techniques.

Exhibit A
Recirculation Air Handling Unit Specifications

| | |
|---|---|
| Equipment name | Recirculation air-handling unit |
| Tag | RAH-2-1 |
| Location | Fan deck |

-continued

Exhibit A
Recirculation Air Handling Unit Specifications

| | |
|---|---|
| Prefilter | |
| Type | 30 percent, disposable |
| Face velocity, maximum | 500 fpm |
| Clean pressure drop | 0.25 inch WC |
| Dirty pressure drop | 0.5 inch WC |
| VOC filter (option) | |
| Type | Activated carbon disposable |
| Face velocity, maximum | 500 fpm |
| Clean pressure drop | 0.5 inch WC |
| Materials of construction | |
| Casing 16-gauge steel | |
| Acoustic Liner | Multidensity fiberglass, totally scrim reinforced, Mylar encapsulated |
| Coil | Aluminum fin, copper tube |
| Drain Pan | Stainless steel |
| Finish Baked-on power-coat polyester | |
| Fan | Aluminum |
| Frame Structural steel | |
| Dampers | 16-gauge galvanized steel |
| Cooling coil | |
| Type | 2-row |
| Fins 0.008-inch aluminum 12 fins per inch max | |
| Tubes 0.02 minimum wall copper | |
| Face velocity, maximum | 500 fpm |
| Entering air temperature | 72° F. |
| Leaving air temperature | 67° F. |
| Air pressure drop | 0.13 inch WG |
| Entering water temperature | 60° F. |
| Leaving water temperature | 65° F. |
| Water pressure drop max | 10 feet head |
| Fluid Water | |
| Leak test | 200 psi air |
| Fan | |
| Type | Centrifugal plug or Vain Axial |
| Total static pressure | 2.25 inches WC |
| External static pressure (clean filters) | 1.25 inches WC |
| Pressure class | AMCA Class I |
| Motor | |
| Type | TEAO high-efficiency extended shaft |
| Air volume modulation | AFD |
| Cabinet | |
| Inlet location | Rear (bottom) |
| Inlet size | (See drawing RAHU) |
| Makeup air location | (Top) (Side) (Rear) |
| Outlet location | Bottom |
| Outlet size | Sized for 1,000 fpm velocity |
| Dampers | |
| Smoke damper | Low leakage downstream of coil same size as coil |
| Makeup air damper | Opposed blade with locking quadrant sized for 10 percent makeup |
| Support (Base mount) (Suspended) | |
| Access door location | Size (TBD), fan (return plenum) wrap around (view windows), (bulb seals) |

Note: All recirculation units should not have anything protruding from maximum cabinet dimensions, with the exception of the AFDs and disconnect switch.

-continued

Exhibit B
Make Up Air Handling Unit Specifications

| | |
|---|---|
| Equipment name | Fab makeup air handler |
| Tag number | MAH-1-1 through MAH-1-4 |
| Reference drawing | MAH |
| Location | Makeup air fan deck |
| Piping connection | Right side |
| Materials of construction | |
| Casing | 16-gauge steel |
| Acoustic liner | Multidensity fiberglass, totally scrim reinforced, Mylar encapsulated |
| Coil | Aluminum fun, copper tube |
| Drain pan | Stainless steel |
| Finish | Baked-on enamel |
| Fan | Aluminum |
| Frame | Structural Steel |
| Dampers | 16-gauge galvanized (blade and jamb seals for isolation) |
| Prefilter | |
| Type | 30 percent deep pleated 4-inch disposable cartridge |
| Face velocity, maximum | 500 fpm |
| Pressure drop, maximum | |
| Clean | 0.25 |
| Dirty | 0.5 |
| Preheat coil | |
| Type | 2 row |
| Fins | 0.008-inch aluminum 8 fpi |
| Tubes | 0.02-inch wall copper |
| Face velocity, maximum | 500 fpm |
| Entering air Temperature, db | 0 to 20° F. |
| Leaving air temperature, db | 40° to 50° F. |
| Air pressure drop, maximum | 0.2 to 0.4 inch |
| Entering water temperature | 100° to 180° F. |
| Leaving water temperature | 70° to 150° F. |
| Water pressure drop, maximum | 10 feet WC |
| VOC filter (alternative) | |
| Type | Activated carbon disposable cartridge |
| Face velocity, maximum | 500 fpm |
| Clean pressure drop | 0.5 inch WC |
| Dirty pressure drop | 0.51 inch WC |
| Main filter section | |
| Type | 12 inches, rigid |
| Face velocity, maximum | 500 fpm |
| Pressure drop, maximum | |
| Clean | 0.5 |
| Dirty | 1 |
| Cooling coil section | |
| Type | |
| Precool | 8 row, 10 fpi |
| Cooling | 6 row 8 fpi |
| Face velocity, maximum | 500 fpm |
| Entering air temperature, db | 100° to 90° F. |
| Entering air temperature, wb | 80° to 70° F. |
| Leaving air temperature, db. | 55° to 49° F. |
| Leaving air temperature, wb | 54° to 48° F. |
| Air pressure drop, maximum | 2.3 inches |
| Entering water temperature | 42° F. |
| Water pressure drop, maximum | 25 feet WC |
| Glycol coil section | |
| Type | 12 row, 8 fpi |
| Face velocity, maximum | 500 fpm |
| Entering air temperature, db | 48° to 50° F. |
| Entering air temperature, wb | 47° to 49° F. |
| Leaving air temperature, db | 40° F. |

Exhibit B
Make Up Air Handling Unit Specifications

| | |
|---|---|
| Leaving air temperature, wb | 39.5° F. |
| Air pressure drop, maximum | 0.9 inch WC |
| Entering glycol temperature | 32° F. |
| Glycol pressure drop, maximum | 20 feet WC |
| Percent glycol | 15 |
| Fan | |
| Type | Centrifugal plug |
| Total static pressure | 8.5 inches WC |
| External static pressure | 0.5 inch WC |
| (Clean filters) | 6 inches WC |
| Pressure class | AMCA Class II |
| Motor type | TEAO high-efficiency extended shaft |
| Air volume modulation | AFD |
| Vibration/Isolation | Internal springs 2-inch deflection with leveling bolts and snubbers |
| Humidifier type | Clean fog injection |
| Reheat coil section | |
| Type | 2 row |
| Fins | 0.008-inch aluminum 12 fins per inch maximum |
| Tubes | 0.02 minimum wall copper |
| Face velocity, maximum | 700 fpm |
| Entering air temperature | 51° F. |
| Leaving air temperature | 56° F. |
| Air pressure drop | 0.2 inch WG |
| Entering water temperature | 90° F. |
| Leaving air temperature | 85° F. |
| Water pressure drop maximum | 10 feet head |
| Fluid | Water |
| Leak test | 200 psi air |
| Final filter section | |
| Type | HEPA 12 inches deep, high capacity |
| Face velocity, maximum | 500 fpm |
| Pressure drop, maximum | |
| Clean | 1.4 |
| Dirty | 2 |
| Discharge plenum | Minimum 6 feet long |
| Options | Spare parts |
| | Fan wheel |
| | Motor |
| | Complete fan assembly |
| | AFD |
| | HEPA filters (one set) |
| | Prefilters (one set) |
| | Alternatives: |
| | Mechanical modulation |
| | VOC carbon filters, 12 inch |
| | Incandescent service lighting |
| | Quick removal fan assembly and wiring for 15-minute replacement |
| | Cooling coil air pressure drop gauge and adjustable flag |
| | Evaporative type humidifier (DI water) |
| | Clean steam injection humidifier |
| | Standard preheat coil with circulation pump |
| | Vane axial fan with inlet and outlet cones |
| | Units not shipped with an AFD have combination magnetic starters with the following: |

-continued

| Exhibit B<br>Make Up Air Handling Unit Specifications | |
|---|---|
| | NEMA 12 enclosure.<br>NEMA ABI circuit breakers with instantaneous magnetic trip in each pole.<br>Provide safety disconnect with lockable off position.<br>NEMA ICS 2 auxiliary contacts, one set N.O./NC.<br>NEMA ICS 2 hand-off-auto switch.<br>NENA ICS 2 push-to-test indicating lights, red (run), green (stop).<br>120-volt control transformer 100 VA miniinum.<br>NEMA ICS 2 overload relays, melting alloy type, rated at motor nameplate rating.<br>Spray water wash with impingment fins |

What is claimed is:

1. An apparatus for providing a resource, to a chase, the chase for containing at least a first portion of at least one piece of equipment for performing at least one process step for processing a first material, at least a portion of the first material different from the resource, at least one of the at least one process step having a first sentivity to contamination, the chase having an inlet for receiving the resource, the apparatus comprising:

a bay for containing at least a second portion of at least one piece of equipment for performing at least one process step for processing a second material, at least a portion of the second material different from the resource, at least one of the at least one process step in the bay having a second sensitivity to contamination more sensitivity than the first sensitivity, the bay having:

an inlet coupled to receive a clean resource substantially excluded from the chase;

a contamination source for contaminating the resource; and an outlet for exhausting at least a portion of the contaminated resource having a first purity from the bay; and a passage coupled between the outlet of the bay and the inlet of the chase to carry to the chase the resource contaminated in the bay and previously substantially excluded from the chase, the resource carried to the chase having a purity not substantially higher than the first purity.

2. The apparatus of claim 1 wherein a resource source comprises:

an input coupled to receive the resource with an unacceptable level of contaminants;

a filter for filtering at least some of the contaminations from the resource; and an output coupled to the bay inlet for providing a clean resource.

3. The apparatus of claim 2 wherein the resource is air.

4. The apparatus of claim 3 wherein the contamination source in the bay is at least one piece of manufacturing equipment.

5. The apparatus of claim 4 wherein the at least one piece of manufacturing equipment is semiconductor manufacturing equipment.

6. The apparatus of claim 1, wherein the bay additionally has an outside air outlet for exhausting at least a portion of the contaminated resource to an environment different from the bay and the chase.

7. The apparatus of claim 1, wherein:

the bay comprises a plurality of locations; and the outlet comprises a plurality of openings, each of the openings at a different location of the bay.

8. The apparatus of claim 7, wherein at least one of the openings comprises a valve.

9. The apparatus of claim 8, additionally comprising a valve controller coupled to at least one of the at least one valve, the valve controller for controlling at least one of the valves in response to at least one valve controller input.

10. The apparatus of claim 9 wherein at least one of the openings comprises a sensor coupled to the valve controller input, the valve controller for controlling at least one of the valves responsive to the at least one sensor.

11. An apparatus for providing a resource to a chase, the chase for containing at least a first portion of at least one piece of equipment for performing at least one process step for processing a first material, at least a portion of the first material different from the resource, at least one of the at least one process step having a first sensitivity to contamination, the chase capable of contaminating the resource, said chase having an inlet for receiving a contaminated resource, the apparatus comprising:

a bay containing at least a second portion of at least one piece of equipment for performing at least one process step for processing a second material, at least a portion of the second material different from the resource, at least one of the at least one process step in the bay having a second sensitivity to contamination more sensitive than the first sensitivity, the bay having:

an inlet coupled to receive a clean resource substantially excluded from the chase;

a contamination source for contaminating the resource; and an outlet for exhausting at least a portion of the contaminated resource from the bay;

a passage coupled between the outlet of the bay and the inlet of the chase to carry to the chase the resource contaminated in the bay and previously substantially excluded from the chase; and a flow preventer for substantially preventing a flow from the chase to the bay of the resource contaminated in the chase.

12. The apparatus of claim 11 wherein the flow preventer comprises at least one valve coupled between the bay and the chase to substantially prevent the flow of the resource from the chase to the bay.

13. The apparatus of claim 11 wherein the flow preventer comprises a pressure adjuster for providing a pressure in at least one selected from the bay and the chase wherein a pressure in the bay is higher than a pressure in the chase.

14. The apparatus of claim 11 wherein the flow preventer comprises at least one fan coupled between the bay and the chase to substantially prevent the flow of the resource from the chase to the bay.

15. The apparatus of claim 11 wherein the flow preventer comprises at least one pump coupled between the bay and the chase to substantially prevent the flow of the resource from the chase to the bay.

16. The apparatus of claim 11 wherein the contamination source in the bay is at least one piece of manufacturing equipment.

17. The apparatus of claim 16 wherein the at least one piece of manufacturing equipment is semiconductor manufacturing equipment.

18. The apparatus of claim 11, wherein:

the bay comprises a plurality of locations; and the outlet comprises a plurality of openings, each of the openings at a different location of the bay.

19. The apparatus of claim 18, wherein the flow preventer comprises at least one valve coupled between the bay and the chase to substantially prevent the flow of the resource from the chase to the bay, the apparatus additionally comprising a valve controller coupled to at least one of the at least one valve, the valve controller for controlling at least one of the at least one valve in response to at least one valve controller input.

20. The apparatus of claim 19 wherein at least one of the openings comprises a sensor coupled to the valve controller input, the valve controller for controlling at least one of the valves responsive to the at least one sensor.

* * * * *

UNITED STATES PATENT AND TRADEMARK OFFICE

CERTIFICATE OF CORRECTION

PATENT NO : 5,972,060

DATED : 10/26/99

INVENTOR(S): Michael D. O'Halloran, Wilmar A. Kohne and Stephen W. Nelson

It is certified that error appears in the above-identified patent and that said Letters Patent is hereby corrected as shown below:

On claim 1, line 1, after "resource", delete ",".

On claim 1, line 15, delete "sensitivity", and insert in place thereof --sensitive--.

On claim 2, line 5, delete "contaminations", and insert in place thereof

--contaminants--.

On claim 11, line 10, between "bay" and "containing", insert --for--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*